US006536514B1

(12) United States Patent
Sugiyama et al.

(10) Patent No.: US 6,536,514 B1
(45) Date of Patent: Mar. 25, 2003

(54) HEAT EXCHANGER AND METHOD FOR PREPARING IT

(75) Inventors: Yoichi Sugiyama, Tokyo (JP); Hidemoto Arai, Tokyo (JP); Kenji Mizoguchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/408,276

(22) Filed: Sep. 29, 1999

(30) Foreign Application Priority Data

May 10, 1999 (JP) ..... 11-128115

(51) Int. Cl.[7] ..... F28F 3/00; F28F 13/18
(52) U.S. Cl. ..... 165/166; 165/54; 165/905
(58) Field of Search ..... 165/166, 54, 905

(56) References Cited

U.S. PATENT DOCUMENTS

| | | | | |
|---|---|---|---|---|
| 3,782,081 A | | 1/1974 | Munters | |
| 3,925,021 A | | 12/1975 | Yoshino et al. | |
| 4,189,330 A | | 2/1980 | Strindehag et al. | |
| 4,377,400 A | * | 3/1983 | Okamoto et al. | 165/54 X |
| 4,449,992 A | * | 5/1984 | Yamada et al. | 55/158 |
| 4,582,129 A | * | 4/1986 | Yano et al. | 165/54 X |
| 4,871,607 A | | 10/1989 | Kuma et al. | |
| 6,145,588 A | * | 11/2000 | Martin et al. | 165/166 |

FOREIGN PATENT DOCUMENTS

| | | | | |
|---|---|---|---|---|
| EP | 0661502 A | | 7/1995 | |
| JP | 4719990 | | 6/1972 | |
| JP | 512131 | | 1/1976 | |
| JP | 5334663 | | 9/1978 | |
| JP | 5416054 | | 6/1979 | |
| JP | 57-115696 | * | 7/1982 | 165/54 |
| JP | 57-207795 | * | 12/1982 | 165/54 |
| JP | 5846325 | | 10/1983 | |

* cited by examiner

*Primary Examiner*—Leonard Leo
(74) *Attorney, Agent, or Firm*—Birch, Stewart, Kolasch & Birch, LLP

(57) ABSTRACT

A method for preparing a heat exchanger, comprising forming a moisture-permeable film having an air-impermeable function on a single side of a plate-shaped porous member to provide a gas-impermeable member for heat exchange, bonding a spacer corrugated for forming a fluid passage to a side of the gas-impermeable member with the moisture-permeable film formed thereon to provide a plurality of heat exchanger constituent elements, and layering the heat exchanger constituent elements so that the spacer in each of the heat exchanger constituent elements forms a fluid passage in each layer.

3 Claims, 4 Drawing Sheets

HEAT EXCHANGER AND METHOD FOR PREPARING IT

The present invention relates to a heat exchanger, which has a layered structure to carry out heat exchange between fluids for mainly air conditioning, and a method for preparing such a heat exchanger.

The latest development and popularization of air conditioning devices for heating and cooling, and the latest enlargement of living accommodations with air conditioning devices have given added importance to heat exchangers for air conditioning that can retrieve temperature and humidity in ventilation. As such heat exchangers have been widely used ones that have been disclosed in, e.g., JP-B-4719990, JP-B-5416054 and JP-B-512131. These heat exchangers have a basic structure wherein partitions having a heat-transfer property and moisture permeability are layered in multi-layered fashion at certain intervals, sandwiching each of spacers between adjoining partitions. The partitions are rectangular flat plates, and the spacers have a projected plane conformed to the partitions and are corrugated in a sawtooth or sinusoidal form. Each of the spacers is sandwiched between adjacent partitions so as to have a wave front thereof directed at 90° or an angle close to this value with respect to the wave front of an adjacent spacer, providing two systems of fluid passages for alternately passing a first flow and a second flow in every other layer.

The characteristics that are required for partitions for a heat exchanger are low air-permeability and high moisture permeability. This is because fresh outdoor air taken indoors from outdoors is prevented from mixing with contaminated air exhausted outdoors from indoors in service and because vapor is required to transfer between the intake air and the exhaust air effectively in order to heat exchange sensible heat and latent heat simultaneously. As a material for partitions to meet the requirements has been developed a gas-impervious member as disclosed in JP-B-5846325. This member can be obtained by impregnating or coating a water-soluble polymer with lithium halide contained as an moisture absorbent into or on a porous member. As disclosed in JP-B-5334663, it has been devised to mix a guanidine type flame retardant in a water-soluble polymer and impregnate or coat the polymer into or on a porous member to improve flame retardance.

In a heat exchanger wherein a moisture-impervious member, which is prepared by impregnating or coating a water-soluble polymer into or on a porous member as stated, is used to provide each of partitions, it has been created a problem in that a part of the water-soluble polymer is melt due to moisture absorption into a partition to bring about a blocking phenomenon and to break a material for a partition during unwinding it for corrugation under conditions of high temperature and high humidity, such as in summer.

Such a heat exchanger is produced by corrugating a spacer material and almost simultaneously bonding the spacer material to a partition material to provide a single faced corrugated board unit as a heat exchanger constitute element and by putting the constituting elements one after another in multi-layered fashion.

Corrugation is carried out by a machine that mainly comprises upper and lower toothed corrugating rolls engaging and rotating together to shape a spacer material and a pressing roll to press the spacer material to a partition material in rotation. In order to provide the spacer material with proper corrugation, the upper and lower corrugating rolls and the pressing roll are normally maintained at a high temperature not lower than 150° C. Since a portion of the water-soluble polymer in or on the partition material is melted by heat from the pressing roll at such a high temperature, the portion of the water-soluble polymer is apt to adhere to the pressing roll. If the temperature of the pressing roll is lowered, a spacer material can not be used as a heat exchanger constitute element due to improper corrugation though a partition material can be prevented from adhering to the pressing roll.

The temperature of the pressing roll and that of the upper and lower corrugating rolls have been controlled to a temperature hardly susceptible to melt and adherence and the feed speed is lowered so as to prevent the formation of improper corrugation up until now. A heat exchanger constituent element in the form of a single faced corrugated board unit may be warped by absorption of the moisture in air or by the moisture in a water-solvent type adhesive used in layering. In order to cope with these problems, a pressing operation has been carried out in the layering process and the bonding process to avoid the occurrence of a warp, which has made the processes quite complicated.

Since temperature exchange effectiveness is different from humid exchange effectiveness in such a type of heat exchanger because of the presence of difference heat exchange areas with respect to temperature exchange and humid exchange, the heat exchanger has created a problem in that enthalpy exchange effectiveness varies according to heat exchange under air conditions having different sensible heat factors, such as in summer and winter.

It is an object of the present invention to solve the problems, and to develop a method for preparing a heat exchanger capable of speeding up corrugation to enhance productivity, to develop a method for preparing a heat exchanger capable of speeding up corrugation to enhance productivity and of having flame retardance, to provide a heat exchanger capable of minimizing a difference in heat exchange effectiveness in summer and winter, and to provide a heat exchanger capable of making the production process simple and of reducing cost.

According to a first aspect of the present invention, there is provided a method for preparing a heat exchanger, comprising forming a moisture-permeable film having an air-impermeable function on a single side of a plate-shaped porous member to provide a gas-impermeable member for heat exchange, bonding a spacer corrugated for forming a fluid passage to a side of the gas-impermeable member with the moisture-permeable film formed thereon to provide a plurality of heat exchanger constituent elements, and layering the heat exchanger constituent elements so that the spacer in each of the heat exchanger constituent elements forms a fluid passage in each layer.

In the first aspect, the moisture-permeable film may be formed by chemical liquid coating or laminating.

According to a second aspect of the present invention, the porous member is made of a paper material, which has been subjected to flame retardant treatment.

In the second aspect, the moisture-permeable film may be formed by chemical liquid coating.

According to a third aspect of the present invention, the heat exchanger constituent elements are bonded together by an adhesive having a flame-retardant property.

The present invention also provides a heat exchanger, which is layered so as to have two systems of fluid passages in different layers, comprising a plurality of partitions for separating two systems of fluid passages, and a plurality of spacers corrugated for forming the fluid passages, wherein the partitions comprise a gas-impermeable member provided by forming an moisture-permeable film having an air-impermeable function on a single side of a plate-shaped porous member, and a spacer is bonded to a side of the gas-impermeable member with the moisture-permeable film formed thereon.

According to a fourth aspect of the present invention, one of the systems of passages is held by the spacers so that opposed partitions have the side of a partition with the moisture-permeable film formed thereon confronted to the side of the other partition with the moisture-permeable film formed thereon.

In the fourth aspect, the moisture-permeable film may be provided by chemical liquid coating or laminating.

According to a fifth aspect of the present invention, the partitions and the spacers comprise a material that has one side and the other side having different stretching properties with respect to humidity, and a side of the partitions that is apt to be easily stretched due to humidity is bonded to a side of the spacers that is apt to be easily stretched due to humidity.

In accordance with the first aspect of the invention, there is provided a method for preparing a heat exchanger capable of speeding up corrugation to enhance productivity.

In accordance with the second aspect of the invention, there is provided a method for preparing a heat exchanger capable of speeding up corrugation to enhance productivity and of having flame retardance.

In accordance with the third aspect of the invention, there is provided a heat exchanger having enhanced flame retardance in addition to the advantages offered by the first aspect or the second aspect of the invention.

In accordance with the fourth aspect of the invention, there is provided a heat exchanger capable of minimizing a difference in heat exchange effectiveness in summer and winter.

In accordance with the fifth aspect of the invention, there is provided a heat exchanger capable of making the production process simple and of reducing cost.

Now, preferred embodiments of the present invention will be described in reference to the accompanying drawings.

Embodiment 1

Figure 1:
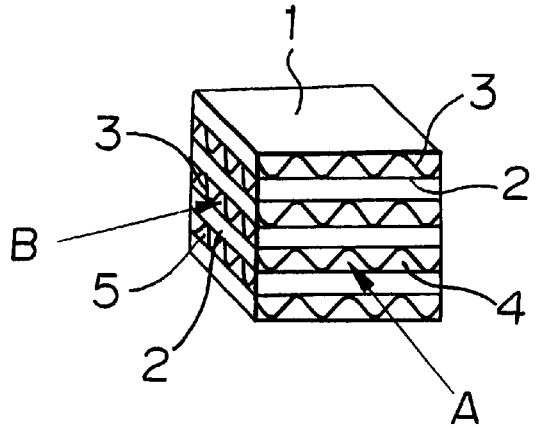
FIG. 1 is a perspective view showing a heat exchanger prepared by the preparation method according to a first embodiment or a second embodiment of the present invention.

The modes shown in FIGS. 1–4 are related to a method for preparing a heat exchanger 1, and the heat exchanger is formed in a hexahedral layered structure as shown in FIG. 1 and suited to air conditioning. The heat exchanger 1 prepared by the preparation method has a structure wherein thin partitions 2 having a heat-transfer property and moisture permeability are piled and bonded one after another at certain intervals in multi-layered fashion, sandwiching a spacer 3 between adjacent partitions. The partitions 2 to form the heat exchanger 1 are shaped in a square or rhombic plate, and the spacers 3 are shaped in a sawtooth or sinusoidal corrugated sheet, which has a projected plane conformed with that of the partitions 2. Each of the spacers 3 is sandwiched between adjacent partitions 2 so as to have a wave front thereof directed at 90° or at an angle close to this value with respect to the wave front of an adjacent spacer, providing a fluid passage 4 and a fluid passage 5 for alternately passing a first flow A and a second flow B in every other layer.

Figure 2:
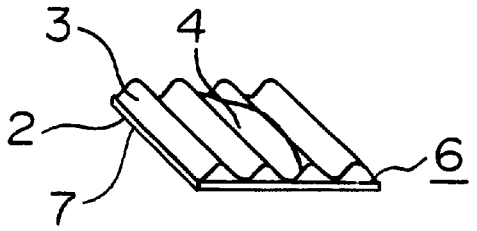
FIG. 2 is a perspective view showing a heat exchanger constituent element produced by the method according to the first embodiment or the second embodiment.
Figure 3:
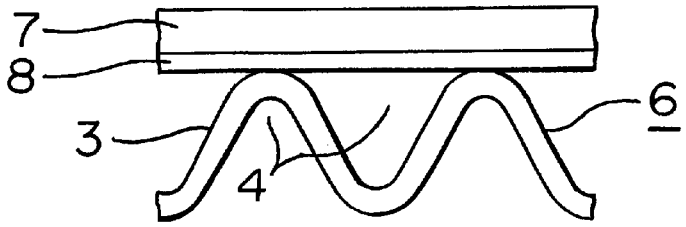
FIG. 3 is an enlarged end view of a part of the heat exchanger constituent element produced by the method according to the first embodiment.

The heat exchanger 1 is prepared by bonding a spacer 3 to a single side of each of the partitions 2 shown in FIGS. 2 and 3 to provide heat exchanger constituent elements 6 and bonding the heat exchanger constituent elements together in the layered structure. Each of the exchanger constituent elements 6 may be successively prepared by applying chemical liquid coating to a single side of a plate-shaped porous member 7 to provide the side with a moisture-permeable film 8 having an air-impermeable function so as to prepare a gas-impermeable member as a partition 2, and bonding a material 9 for a spacer 3 forming the fluid passages 4 and 5 to the side of the moisture-permeable film 8 on the gas-impermeable member while corrugating the material 9.

Figure 4:
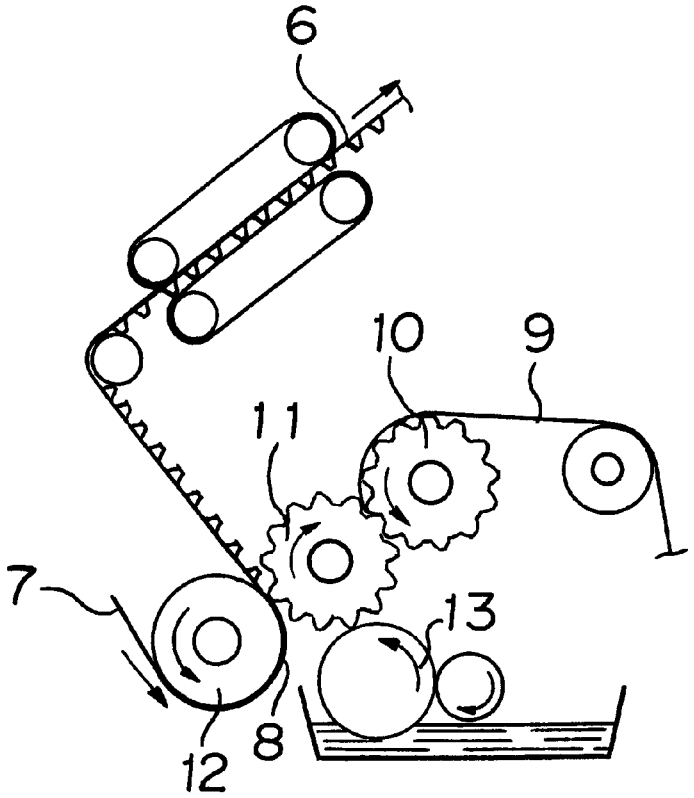
FIG. 4 is a schematic view showing corrugation in the method according to the first embodiment.

The porous member 7 is made of a paper material, which has a thickness of about 60–120 $\mu$m and a basic weight of 25–150 (g/m$^2$) and mainly comprises cellulose fibers. The moisture-permeable film 8 is formed from chemical liquid, which is prepared by dissolving polyvinyl alcohol (PVA) or a similar one as water-soluble polymer in water, and mixing lithium chloride as a chemical having a moisture absorption power and sulfamic acid guanidine as a flame retardant with the water. The chemical liquid for forming the moisture-permeable film is coated on the single side of the porous member 7 at a speed of about 10–50 m/min by a roll quarter, and the chemical liquid is immediately dried to prepare a partition material. The partition material is fed into a single facer as shown in FIG. 4. The chemical liquid has a coated amount of 10–30 g/m$^2$ after drying the porous member 7 for the partitions.

The porous member 7 for the partitions has the single side formed with the moisture-permeable film 8 to exhibit an air-impermeable function, a moisture absorption power and a flame-retardant function. The paper material for the spacers 3 with cellulose fibers mainly contained therein is fed into the single facer, and the paper material is corrugated to successively prepare the heat exchanger constituent elements 6 in the continuous form of a single faced corrugated board. The corrugating machine mainly comprises upper and lower toothed corrugating rolls 10 and 11 engaging and rotating together to form a spacer 3 in a continuous form, a pressing roll 12 for pressing the porous member 7 as the material of a partition 2 in a continuous form to the material 9 for the spacer 3 during rotation, and a gluing roll 13. In order to provide the spacer 3 with proper corrugations, the upper and lower corrugating rolls 10 and 11, and the pressing roll 12 are maintained at a high temperature to provide proper corrugations easily. The gluing roll 13 applies a water-solvent type adhesive of vinyl acetate resin emulsion to ridges of the corrugations of the material 9 for the corrugated spacer 3 fed out from the lower corrugating roll 11. The material for the continuous partition 2 is fed, having the side without the moisture-permeable film 8 faced to the pressing roll 12, and the side of the moisture-permeable film 8 serves as a bonding surface with the material 9 for the spacer 3. The heat exchanger 1 as shown in FIG. 1 is prepared by cutting the heat exchange constituent elements 6 in the continuous form thus prepared into discrete heat exchanger constituent elements, and layering and bonding the discrete heat exchanger constituent elements while alternatively changing the directions of the discrete heat exchanger constituent elements by 90°. By layering the discrete heat exchanger constituent elements 6 so as to direct the wave fronts of the spacer 3 in the discrete heat exchanger constituent elements in parallel with one another, an opposed-flow heat exchanger may be provided.

The characteristics of the method for preparing the heat exchanger 1 are that even if the upper and lower corrugating rolls 10 and 11, and the pressing roll 12 are maintained at a high temperature to provide proper corrugations in the corrugation shown in FIG. 4, the moisture-permeable film 8 is not subjected to melt by heat and the porous member 7 as the material for the partition 2 is prevented from adhering to the pressing roll 12 since the moisture-permeable film 8 is absent on the side of the pressing roll 12 and since the porous member 7 per se contacts the pressing roll 12, and that the corrugation can be carried out at a high temperature suited to provide proper corrugations and at an increased feed speed. The method according to the present invention can carried out the corrugation at a feed speed of about three times quicker than that in the conventional corrugation, not only remarkably improving productivity but also reducing machining cost to about ⅓.

The porous member 7 may have a resin film of an organic material laminated on a single side thereof to provide the moisture-permeable film 8 thereon, and the porous member thus prepared may be used as a material for a partition 2, offering similar advantages. When the moisture-permeable film 8 is formed from a polyester film having a thickness of about 10–20 $\mu$m, and when the spacer 3 is made of a sheeted material which is obtainable by mixing polyester fibers cognate to the film and cellulose fibers, followed by sheeting, the spacer can be bonded to the partition by heating without an adhesive in the corrugating machine, allowing the corrugation to be carried out more rapidly.

Embodiment 2

Figure 5:
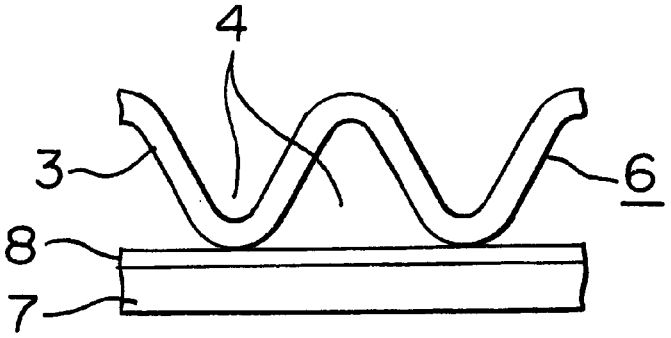
FIG. 5 is an enlarged end view of a part of the heat exchanger constituent element produced by the method according to the second embodiment.
Figure 6:
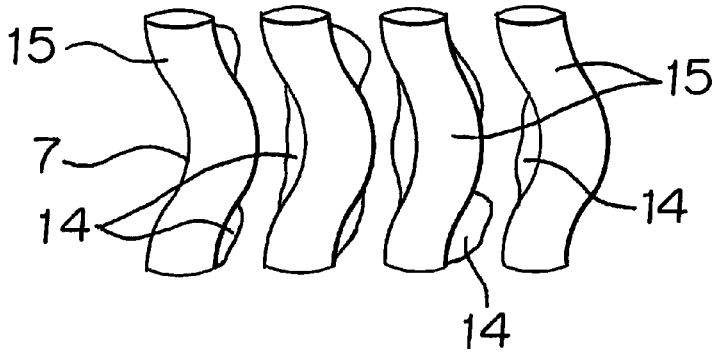
FIG. 6 is an enlarged view schematically showing the structure of a partition produced by the method according to the second embodiment.

The modes shown in FIGS. 5 and 6 are related to a method for preparing a heat exchanger, and the heat exchanger is formed in a hexahedral structure and suited to air conditioning as in the first embodiment. The preparation method according to this embodiment is basically similar to the preparation method according to the first embodiment except for the composition of the partition. Explanation of the second embodiment will be made, referring to FIGS. 1 and 2 as well. Parts similar to those in the first embodiment are indicated by the same reference numerals as those in the first embodiment, and explanation of these parts in the second embodiment will be omitted.

The heat exchanger 1 prepared by the preparation method according to this embodiment also has a structure wherein thin partitions 2 having a heat-transfer property and moisture permeability are piled and bonded one after another at certain intervals in multi-layered fashion, sandwiching a spacer 3 between adjacent partitions. The partitions 2 to form the heat exchanger 1 are shaped in a square or rhombic plate, and the spacers 3 are shaped in a sawtooth or sinusoidal corrugated sheet, which has a projected plane conformed with that of the partitions 2. Each of the spacers 3 is sandwiched between adjacent partitions 2 as shown in FIG. 1 so as to have a wave front thereof directed at 90° of at an angle close to this value with respect to the wave front of an adjacent spacer, providing the fluid passage 4 and the fluid passage 5 for alternately passing the first flow A and the second flow B in every other layer.

The heat exchanger 1 according to this embodiment is also prepared by bonding a spacer 3 to a single side of each of the partitions 2 shown in FIG. 2 as in the first embodiment to provide heat exchanger constituent elements 6 and bonding the heat exchanger constitute elements together in the layered structure. Each of the heat exchanger constituent elements 6 may be successively prepared by applying chemical liquid coating to a single side of a plate-shaped porous member 7 to provide the side with a moisture-permeable film 8 having an air-impermeable function so as to prepare a gas-impermeable member as a partition 2, and bonding a material 9 for a spacer 3 forming the liquid passages 4 and 5 to the side of the moisture-permeable film 8 on the gas-impermeable member while corrugating the material 9.

As the porous member 7 is used flame-resistant paper standardized to Japanese Industrial Standard A1322. The flame-resistant paper has a flame retardant 14 mixed with cellulose fibers 15 thereof during sheeting, and the flame-resistant paper is a paper material, which has a thickness of about 60–120 $\mu$m and a basic weight of 25–150 (g/m ). As the flame retardant 14 is suited sulfamic acid guanidine in consideration of compatibility to the single facer and environment though a guanidine type flame retardant is generally used. The flame retardant 14 is mixed at an amount of 10–40% of the total weight of the paper material. The preliminary mixture of the flame retardant 14 can reduce stickiness on surfaces of the paper material to provide easy handling. Since the flame retardant 14 generally has a high moisture absorption power, the moisture content can be improved in comparison with unprocessed plain paper by selecting an agent having a high moisture absorption power as the flame retardant 14.

With respect to the moisture permeability, water molecules, which have condensed in an outer layer of the partitions 2, move in the form of water in capillary tubes provided in the fibrous layer in the partitions 2 and evaporate through the outer layer on the opposite side in a moisture permeation process. Since the provision of the flame retardant 14 among the cellulose fibers 15 makes the size of the capillary tubes in the partitions 2 smaller as shown in FIG. 6, capillarity can be brought about by the presence of moisture in a smaller amount than the past to make the movement of moisture to the outer layer on the opposite side easy in the moisture permeation process. As a result, the heat exchanger 1 can be provided so as to have superior humid exchange effectiveness.

The moisture-permeable film 8 is formed from chemical liquid, which is prepared by dissolving polyvinyl alcohol (PVA) or a similar one as water-soluble polymer in water and mixing lithium chloride as a chemical having a moisture absorption power and sulfamic acid guanidine as a flame retardant with the water. The chemical liquid for forming the moisture-permeable film is coated on the single side of the porous member 7 as a speed of about 30–70 m/min by a roll quarter, and the chemical liquid is immediately dried to prepare a partition material. The partition material is fed into a single facer as shown in FIG. 4 with respect to the first embodiment. The chemical liquid has a coated amount of about 5–15 g/m$^2$ after drying the porous member 7 for the partitions 2.

The flame-resistant paper for forming the partitions 2 has the single side formed with the moisture-permeable film 8 to exhibit an air-impermeable function, a moisture absorption power and a flame-retardant function. The material 9 for the spacer 3 with cellulose fibers mainly contained therein is fed into the single facer, and the material for the spacer is corrugated to successively prepare the heat exchanger constituent elements 6 in the continuous form of a single faced corrugated board in a way similar to that explained with respect to the first embodiment. The heat exchanger 1 as shown in FIG. 1 is prepared by cutting the heat exchange constituent elements 6 in the continuous form thus prepared into discrete heat exchanger constituent elements, and layering and bonding the discrete heat exchanger constituent elements while alternately changing the directions of the perspective discrete heat exchanger constituent elements by 90°. In accordance with the preparation method of this embodiment, the coating amount of the chemical liquid for forming the moisture-permeable film 8 can be reduced in comparison with the first embodiment since the flame-resistant paper, which has been preliminarily subjected to flame-retardant treatment, is used as the material for the partitions 2. An increase in the chemical liquid coating speed in the preparation can further improve productivity. The preparation method according to this embodiment is similar to the preparation method according to the first embodiment in terms of the other advantages.

In this mode as well, an opposed-flow heat exchanger may be provided by layering the discrete heat exchanger constituent elements 6 so as to direct the wave fronts of the spacer 4 in the discrete heat exchanger constituent elements in parallel with one another. The flame-resistant paper may have a resin film of an organic material laminated on a single side thereof to provide the moisture-permeable film 8 thereon, and the flame-resistant paper thus prepared may be used as a material for the continuous partition 2, offering similar advantages. When the moisture-permeable film 8 is formed from a polyester film having a thickness of about 10–20 $\mu$m, and when the spacer 3 is made of a sheeted material which is obtainable by mixing polyester fibers cognate to the film and cellulose fibers, followed by sheeting, the spacer can be bonded to the partition by heating without an adhesive in the corrugating machine, allowing the corrugation to be carried out more rapidly.

Embodiment 3

Figure 7:
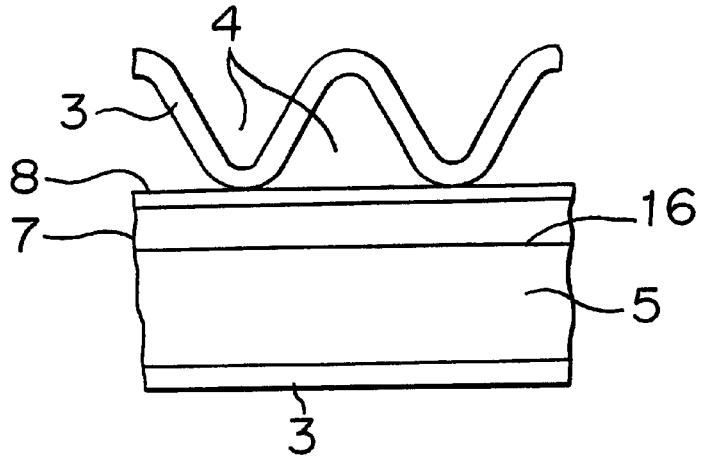
FIG. 7 is an enlarged end view of a part of a heat exchanger produced by the preparation method according to a third embodiment of the present invention.

The mode shown in FIG. 7 is related to a method for preparing a heat exchanger, wherein an agent, which is prepared by mixing a water-solvent type adhesive of vinyl acetate resin emulsion and a flame retardant including emulsion resin with a bromine compound and metallic oxide incorporated, is used as an adhesive 16 for bonding the discrete heat exchanger constituent elements 6 when the discrete heat exchanger constituent elements 6 prepared by the preparation method according to the first embodiment or the second embodiment are layered.

By layering and bonding the discrete heat exchanger constituent elements 6 by means of such an adhesive 16 while alternately changing the directions of the discrete heat exchanger constituent elements by 90°, the side of the porous member 7 without the moisture-permeable film 8 formed by chemical liquid coating or laminating can be provided with flame retardance by the adhesive 16 to contribute to improved flame retardant in the heat exchanger 1 as a whole. A sample wherein the heat exchanger constituent elements 6 were bonded with the adhesive 16 was compared to a sample wherein the heat exchanger constituent elements 6 were bonded with an adhesive of vinyl acetate resin emulsion in accordance with a combustion test prescribed Japanese Industrial Standard (JIS.) A1322. The test showed that the length after carbonization was 7 cm for the former sample and 8.6 cm for the latter sample, which means that improved flame retardance was recognized.

When the material for the partition 2 is bonded to the material 9 for the spacer 3 to prepare the continuous heat exchanger constituent element 6 in the corrugating machine, the adhesive which is prepared by mixing a water-soluble adhesive of vinyl acetate resin emulsion with a flame retardant for emulsion resin with a bromine compound and metallic oxide incorporated therein can be used to further improve the flame retardance of the heat exchanger 1.

Embodiment 4

Figure 8:
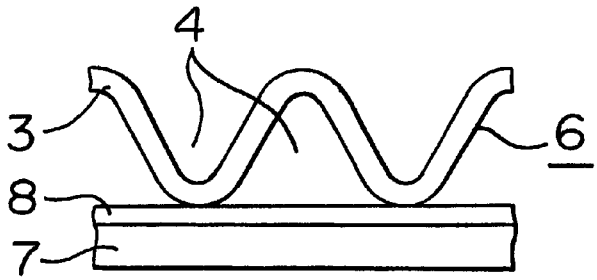
FIG. 8 is an enlarged end view of a part of a heat exchanger constituent element for the heat exchanger according to a fourth embodiment of the present invention.
Figure 9:
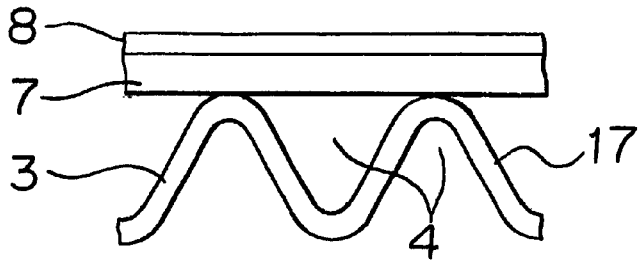
FIG. 9 is an enlarged end view of a part of a heat exchanger constituent element for the heat exchanger according to the fourth embodiment.
Figure 10:
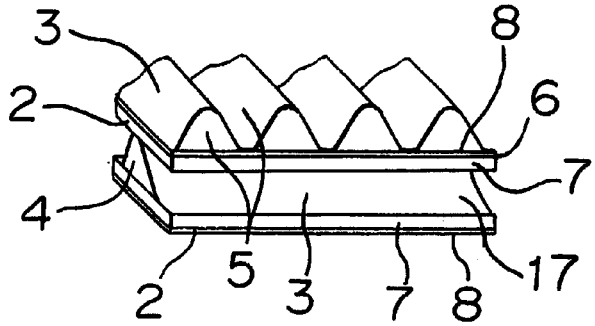
FIG. 10 is a fragmentary end view of the heat exchanger according to the fourth embodiment.

The modes shown in FIGS. 8, 9 and 10 are related a heat exchanger, wherein each of the discrete heat exchanger constitute elements 6 prepared by the method according to the first embodiment or the second embodiment are bonded to each of discrete heat exchanger constituent elements 17 having a different structure in layered fashion. In the heat exchanger constituent elements 6 according to the first embodiment and the second embodiment, the porous member 7 has the side with the moisture-permeable film 8 provided bonded to the material 9 for the spacer 3. The discrete heat exchanger constituent elements 17 are prepared so that the porous member has the side without the moisture-permeable film bonded to the material 9 for the spacer 3 as shown in FIG. 9, which is opposite to the arrangement in the heat exchanger constituent elements 6. The heat exchanger constituent elements 6 and the heat exchanger constituent elements 17 are alternately layered and bonded together so as to have the moisture-permeable film 8 on a cut partition 2 confronted to the moisture-permeable film 8 on an adjacent cut partition 2 in the fluid passage 4 as shown in FIG. 10, providing the heat exchanger.

The two kinds of heat exchanger constituent elements 6 and 17 have a difference in one side and the other side in terms of the moisture-permeability of the partitions 2 since the partitions of both heat exchanger constituent elements have the moisture-permeable film 8 formed on a single side thereof. When cut sections of two kinds of heat exchanger constituent elements 6 and 17 are layered as shown in FIG. 10, the transfer of humid from the passage 5 to the passage 4 has a greater transferring rate than the transfer of humid from the passage 4 to the passage 5. In a heat exchanger having the conventional layered structure, summer has poorer total heat exchange effectiveness than winter. This is because humid occupies a greater proportion with respect to total heat in summer wherein humid exchange effectiveness is lower than temperature exchange effectiveness. In accordance with the heat exchanger of this embodiment, the fluid passage 5 can have the moisture-permeable film 8 of a partition 2 confronted to the moisture-permeable film 8 on the opposed partition 2 to flow a fluid having a higher humidity in summer therein, minimizing the difference between summer and winter in terms of total heat exchanger effectiveness and decreasing the difference between summer and winter in terms of enthalpy exchange rate.

A heat exchanger was prepared so as to have a plane area of 300 mm×300 mm and a height of 500 mm in accordance with this embodiment and was tested. The test shows that the difference between summer and winter with respect to total heat exchange effectiveness was improved by about 30%. In accordance with this embodiment, the issue of design for air conditioning in consideration of a difference in heat recovery between summer and winter can become less important. The heat exchanger structure according to this embodiment can be applied to not only a crossflow heat exchanger but also an opposed-flow heat exchanger with the wave front of a spacer 3 arranged in parallel with those of an adjacent spacer.

Embodiment 5

Figure 11:
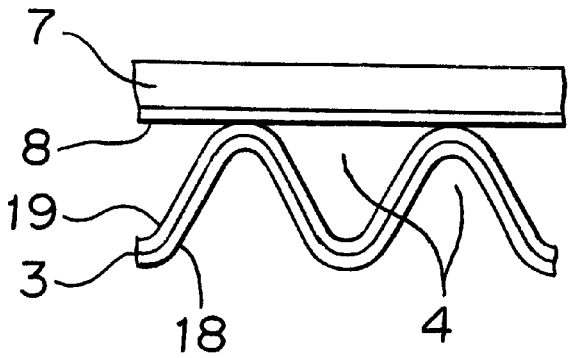
FIG. 11 is an enlarged end view of a part of the heat exchanger constituent element according to a fifth embodiment of the present invention.

The mode shown in FIG. 11 is also related to a heat exchanger for air conditioning in a layered structure, wherein two systems of fluid passages alternately extend crosswise or in parallel every other layer as in the fourth embodiment. In the heat exchanger according to this embodiment, the partitions 2 for separating the fluid passages 4 and 5, and the spacer 3 for holding a certain spacing between adjacent partitions 2 have one side and the other side made of different materials in terms of a stretch due to humidity. The layered structure is provided by bonding the side of a spacer 3 that is apt to be stretched by humidity and a side of a partition 2 that is apt to be stretched by humidity.

The spacer 3 is made of a paper material, which has a single side formed as a first portion 18 comparatively less susceptible to a stretch due to moisture and has the other side formed as a second portion 19 comparatively susceptible to a stretch due to moisture. The first portion 18 is made to provide a calender sheet surface by being solidified and calendered in a drying process in sheeting. The second portion 19 is made to provide a normal sheet surface without being calendered at the drying process. The partition 2 has a structure similar to that in the first embodiment or the second embodiment. The spacer 3 is bonded to the partition so as to have ridges on the second portion bonded to the moisture-permeable film 8 in a corrugating machine. In conventional heat exchangers, the spacer 3 is stretched by the moisture in a water-solvent type adhesive of resin emulsion to bring about irregularities in layering since the adhesive is applied to the ridges of the spacer 3 when the discrete heat exchanger constituent elements 6 are layered and bonded together.

However, the heat exchanger according to this embodiment can reduce the occurrence of a warp and minimize the irregularities in layering and bonding since the side of the spacer 3 to apply the water-solvent type adhesive of resin emulsion comprises the first portion, which is hardly susceptible to a warp due to moisture. As a result, it is possible to improve productivity without carrying out a pressing operation for restraining the occurrence of a warp or correcting the warp in the layering and bonding process. When a paper material difficult to absorb moisture and a water-solvent type adhesive are used to carry out the processing in a corrugating machine, the processing speed is normally required to be slower than usual since it takes some time to exhibit a bonding force. However, the heat exchanger according this embodiment can offer an advantage in that it is not necessary to make the processing speed slower since the bonding of the second portion with the partition 2 allows the bonding force to be exhibited rapidly. Although the side of the partition 2 with the moisture-permeable film 8 formed thereon is apt to absorb moisture to be easily stretched, the bonding of the partition with the second portion of the spacer 3 can cancel a stretching force in the heat exchanger constituent elements 6 to improve the quality of appearance in the entire heat exchanger.

What is claimed is:

1. A heat exchanger, which is layered so as to have two systems of fluid passages in different layers, comprising a plurality of partitions for separating two systems of fluid passages, and a plurality of spacers corrugated for forming the fluid passages, wherein the partitions comprise a gas-impermeable member provided by forming an moisture-permeable film having an air-impermeable function on a single side of a plate-shaped porous member, and the spacers are bonded to a side of the gas-impermeable member with the moisture-permeable film formed thereon and, wherein the partitions and the spacers each comprise a material that has a one side and an other side having different stretching properties with respect to humidity, and a side of the partitions that is apt to be easily stretched due to humidity is bonded to a side of the spacers that is apt to be easily stretched due to humidity.

2. The heat exchanger according to claim 1, wherein one of the systems of passages is held by the spacers so that opposed partitions have the side of a partition with the moisture-permeable film formed thereon confronted to the side of the other partition with the moisture-permeable film formed thereon.

3. The heat exchanger according to claim 2, wherein the moisture-permeable film is provided by one of chemical liquid coating and laminating.

* * * * *